United States Patent [19]

Lewis

[11] 4,291,472

[45] Sep. 29, 1981

[54] DRYING APPARATUS FOR AQUEOUS COATED ARTICLES AND METHOD

[75] Inventor: Philip J. Lewis, Corona, Calif.

[73] Assignee: Brogdex Company, Pomona, Calif.

[21] Appl. No.: 940,754

[22] Filed: Sep. 8, 1978

[51] Int. Cl.[3] ..... F26B 3/04

[52] U.S. Cl. ..... 34/31; 34/34; 34/212; 34/216; 99/475; 99/483; 426/305; 426/455

[58] Field of Search ..... 426/305, 308, 310, 455, 426/456, 465; 34/212, 216, 217, 31, 33, 34, 35, 86; 99/475, 477, 483; 432/128, 145, 152

[56] References Cited

U.S. PATENT DOCUMENTS

| | | | |
|---|---|---|---|
| 863,830 | 8/1907 | Ashley et al. | 34/216 |
| 1,213,549 | 1/1917 | Sibson et al. | 34/212 |
| 1,608,263 | 11/1926 | Fiege | 34/212 |
| 1,932,124 | 10/1933 | Tobey | 34/217 |
| 2,104,135 | 1/1938 | Morrill | 34/212 |
| 2,752,250 | 6/1956 | Kasser | 426/305 |
| 2,799,096 | 7/1957 | Scott | 34/31 |
| 3,849,904 | 11/1974 | Villalobos | 34/216 |
| 3,923,449 | 12/1975 | Brock | 34/212 |

*Primary Examiner*—Larry I. Schwartz

*Attorney, Agent, or Firm*—Poms, Smith, Lande & Rose

[57] ABSTRACT

A method and apparatus for drying articles, such as fruit, which are treated with an aqueous coating such as a wax composition to preserve and to enhance the appearance of the article. The drying apparatus comprises a plurality of housing sections, each providing substantially closed chambers through which a conveyor means carries and advances articles to be dried at a selected rate of speed. The conveyor and a strata of articles carried thereon form a perforate zone in each housing section. Drying air is directed downwardly into a side passageway means at one side of each chamber to pass into a plenum chamber below the conveyor means and to then flow upwardly and substantially uniformly through the conveyor means and strata of articles thereon. Drying air is drawn from an upper chamber above the conveyor means by a blower which directs the drying air into side passageway means downwardly and into the plenum chamber of the next adjacent downstream housing section. Flow of drying air through each of the housing sections is maintained at a substantially equal flow rate. A method of drying aqueous coatings on fruit by passing drying air upwardly through a strata of fruit at substantially a uniform flow rate over the entire area of the strata of fruit, and controlling the temperature and humidity of the drying air.

8 Claims, 5 Drawing Figures

DRYING APPARATUS FOR AQUEOUS COATED ARTICLES AND METHOD

BACKGROUND OF INVENTION

Fruits, such as citrus fruit and apples, are commercially treated with an aqueous coating of wax composition material or other preservative material to protect the fruit during periods of storage and in transit and to enhance the appearance of the fruit at the marketplace. It is desirable that the surface of the fruit be commercially dry to facilitate handling, packing and shipping. Aqueous coatings applied to fruit are considered to be commercially dry, that is, sufficient water removed, when they are not tacky, portions of the coating are not transferred to other equipment upon contact therewith such as conveyors, and the coating is pliable and does not crack or powder.

Fruit such as apples may be stored at temperatures close to freezing and during application of a protective coating thereto may sweat and become moist from water condensing from the air. Water to be removed by drying includes not only water in the aqueous coating, but also moisture remaining on the apple prior to waxing. Citrus fruit, such as lemons, may be stored at higher temperatures, in the nature of 42°–58° F.; and the water to be removed by drying is essentially that water in the aqueous coating, water left after washing, or water not removed after washing.

Prior proposed fruit drying apparatus have included open type dryers in which a series of fans were positioned above a roll conveyor, alternate fans being equipped with hot water or steam coils for heating air directed downwardly on the fruit. Such an open-type dryer of approximately 6 feet wide and 48 feet long with a conveyor moving at about 10–20 feet per minute was designed to handle 900 cartons per hours or a total of 50,000 lbs. of fruit per hour (55 lbs. per carton). The hot water or steam coils used between 800,000 to 1,000,000 BTU's with a consequent drying time of 2½ to 3 minutes.

Another prior proposed dryer was designed to handle 1500 cartons per hour or 82,500 lbs. of fruit per hour. This dryer had an area of 280,000 square feet and required 1.2 million BTU's to heat 12,000 CFM with motors of 13 to 15 hp required for moving the air. Drying time in this dryer was approximately 2 to 2½ minutes. In prior proposed dryer constructions known to me, the fans or blowers used to circulate heated air were arranged above the conveyor means and spaced along the length of the conveyor means. Thus, drying air was blow downwardly and directly against the layer of fruit carried by the conveyor means. The temperature of drying air in such prior proposed apparatuses was often as high as 160° F. to provide suitable drying. Drying air which passed through the layer of fruit and through the conveyor means was discharged to atmosphere.

SUMMARY OF INVENTION

The present invention relates to a novel dryer apparatus which is more efficient and effective than prior proposed dryers in that the temperature of the heated air used is reduced, the amount of BTU's required to accomplish drying is reduced, the drying air is uniformly distributed with respect to the area of the layer or strata of fruit being carried by the conveyor means, and the drying air is recycled for intermixing with fresh air to provide drying air of desired temperature and humidity. The invention particularly relates to a drying apparatus having a novel flow path of heated drying air which is circulated through a plurality of module-like dryer housing sections, each having substantially closed drying chambers, except for the passage therethrough of a continuous conveyor means carrying fruit to be dried and the uniform flow of drying air into and out of the drying chambers.

The present invention contemplates a dryer apparatus in which flow of drying air is equalized along the length of the dryer which is adapted to handle 1500 cartons per hour or 82,500 lbs. of fruit while requiring only 400,000 BTU, motor requirements of 9¼ hp for flow of air, and a reduced drying time of 1½ minutes, the conveyor requiring only 224 sq. ft. of drying area. The dryer apparatus of the present invention also contemplates utilizing the space beneath the conveyor means as a plenum chamber into which drying air is introduced from one side of the conveyor means for flow upwardly through the conveyor means and the strata of fruit into an upper chamber above the dryer conveyor means and then drawn from the upper chamber by blower means located at one side of the conveyor means. The blower means discharges air into and through air passageway means at one side of and below the conveyor means passing through the adjacent downstream housing section of the dryer apparatus for entry into the plenum chamber of the downstream housing section. The blowers at each housing section are controlled so that flow of drying air is balanced or equalized between adjacent housing sections. The invention contemplates the use of the conveyor means and the strata of fruit thereon as a perforate zone which defines an outflow area from the plenum chamber of selected area with respect to the area of the conveyor and strata of fruit and which thereby assists in providing uniform flow of drying air through that part of the conveyor means in a housing section.

The primary object of the present invention, therefore, is to provide a novel apparatus for drying articles, such as fruit or the like which carry a certain quantity of moisture which is desirable to be removed before handling, packing, storage, or other uses.

An object of the invention is to provide a drying apparatus which is constructed and arranged to effectively accomplish drying in a minimum of time.

Another object of the invention is to provide a drying apparatus wherein drying air is circulated in a novel flow path to effectively dry articles.

Another object of the invention is to provide a drying apparatus as above mentioned in which the requirements of motor horsepower and BTU's of heat are reduced substantially.

A further object of the invention is to provide a novel method of drying aqueous coated articles, such as fruit or the like.

A still further object of the invention is to provide a method of drying aqueous coated articles wherein the temperature and humidity of the drying air is readily controlled.

Various other objects and advantages of the present invention will be readily apparent from the following description of the drawings in which an exemplary embodiment of the invention is shown.

IN THE DRAWINGS

Figure 1:
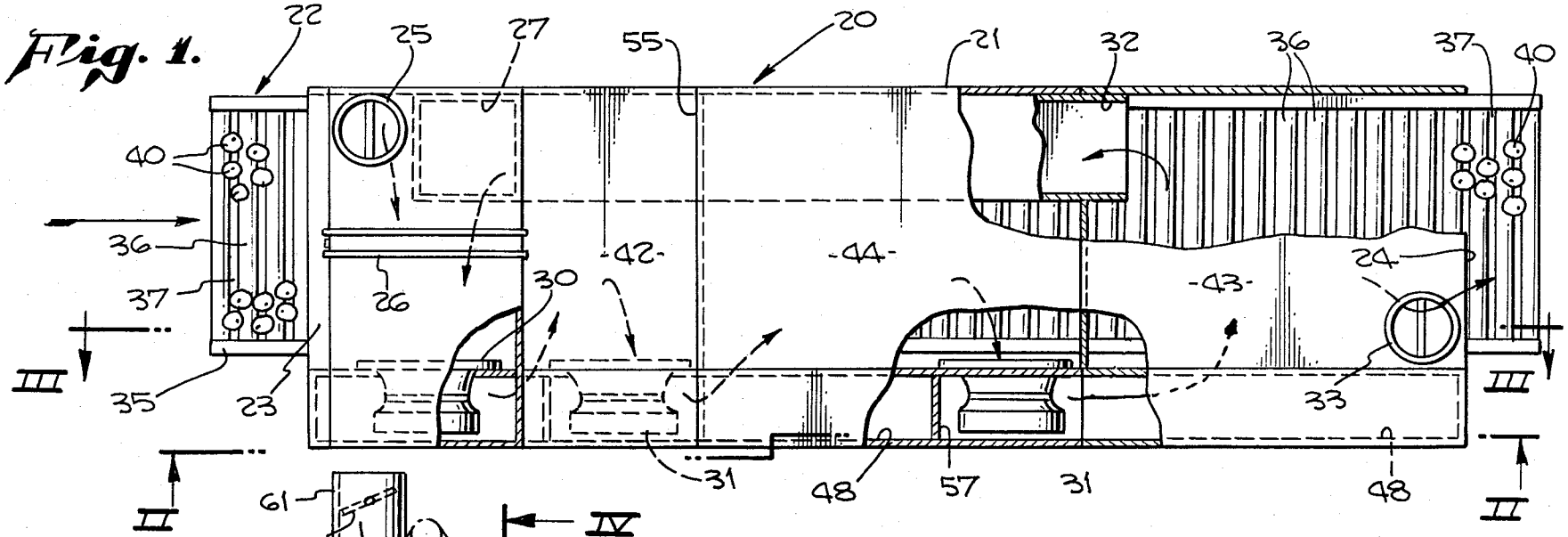
FIG. 1 is a top plan view of a dryer apparatus embodying this invention, a portion of the top wall being broken away to show a portion of the conveyor means.
Figure 2:
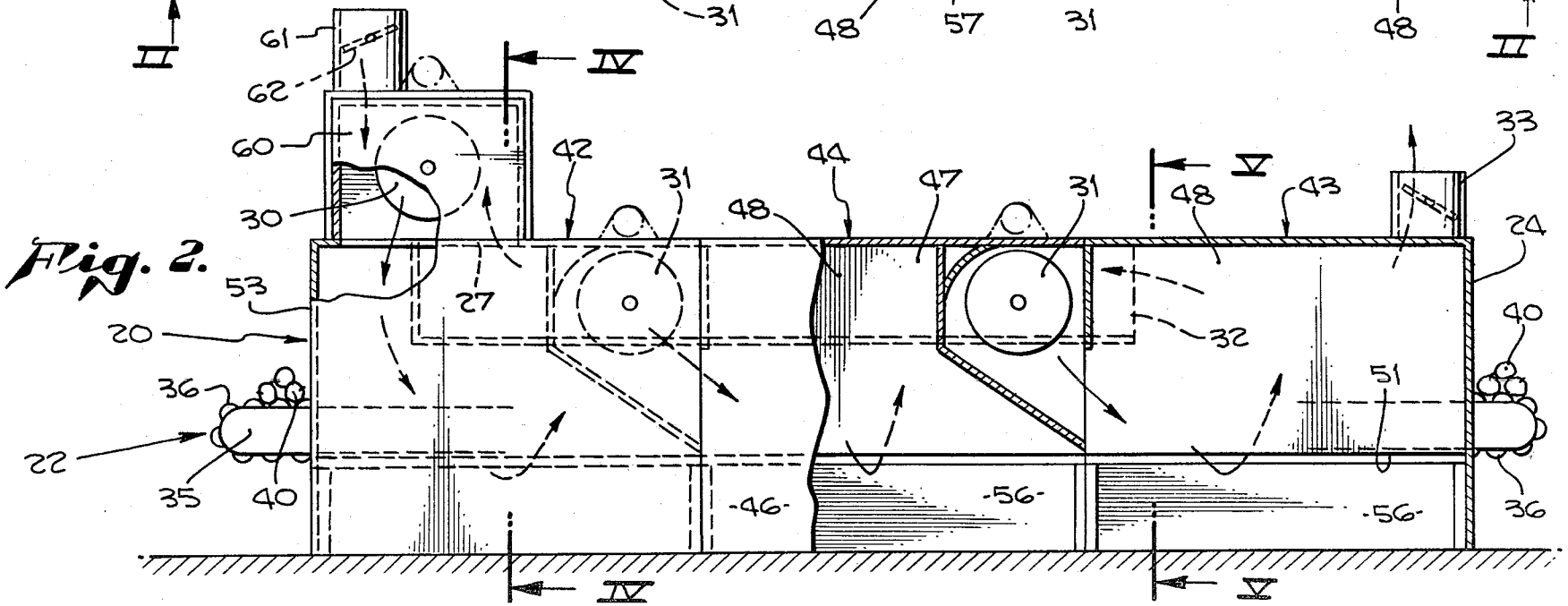
FIG. 2 is a side elevational view of FIG. 1, partly in section, the section being taken in the plane indicated by line II—II of FIG. 1.
Figures 3, 4, 5:
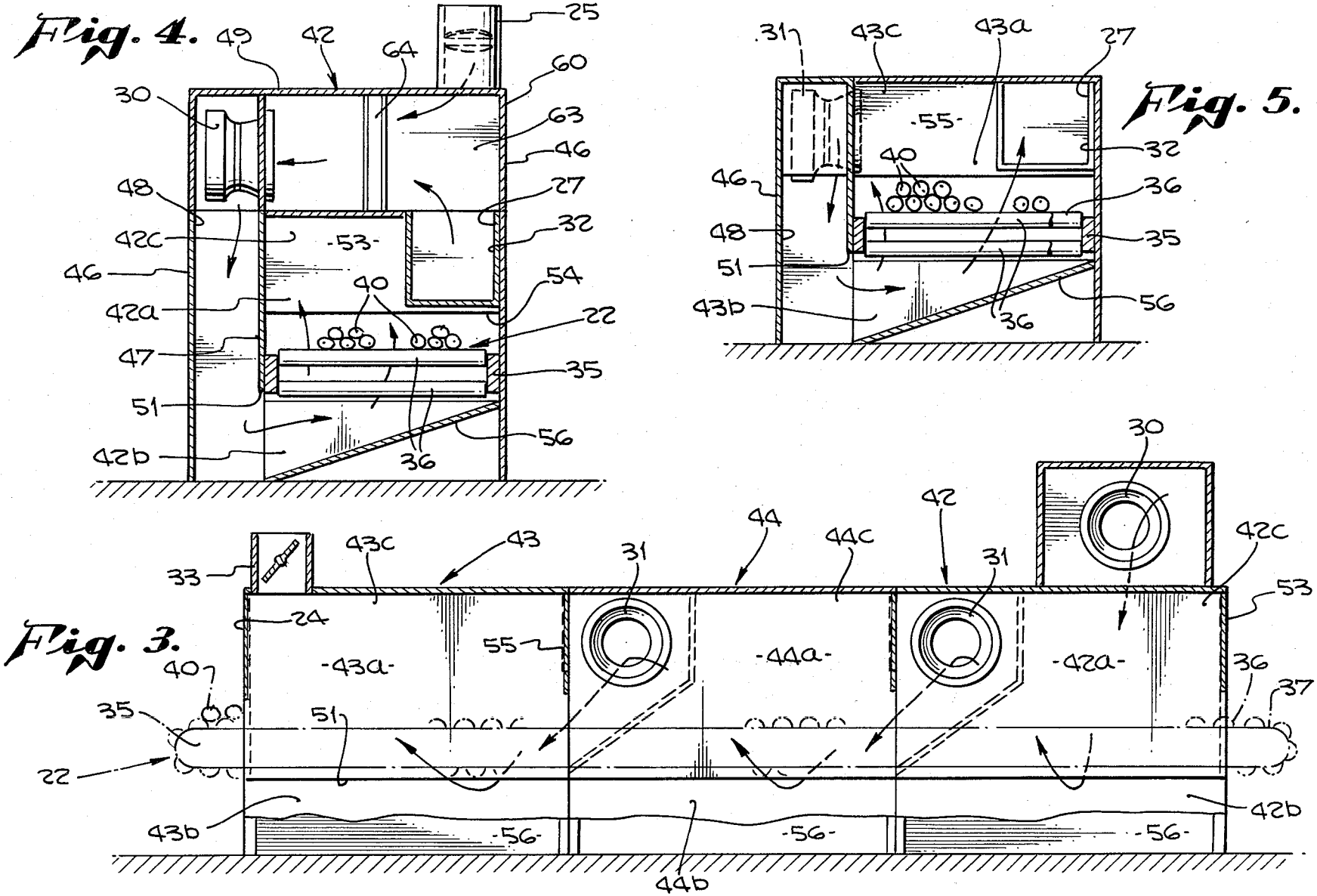
FIG. 3 is a sectional view taken in the vertical longitudinal plane indicated by line III—III of FIG. 1.
FIG. 4 is a transverse sectional view taken in the vertical plane indicated by line IV—IV of FIG. 2.
FIG. 5 is a transverse vertical sectional view taken in the plane indicated by line V—V of FIG. 2.

A dryer apparatus embodying this invention is generally indicated at 20 and may comprise a dryer housing means 21 through which extends a conveyor means 22 for articles such as fruit to be dried. Housing means 21 has an inlet end 23 and an outlet end 24 for the conveyor means. Fresh air inlet means 25 is provided adjacent inlet end 23, the fresh air being passed through a heat exchanger 26 and intermixed with recycled air entering at 27. The intermixed air is then circulated in novel manner through housing means 21 by a first blower means 30 and successively arranged blower means 31 as more particularly described later. Adjacent the outlet end of housing 21, a controlled vent 33 to atmosphere permits escape to atmosphere of a part of the moisture ladened air while the remaining air enters a return passageway means 32 for recycling and mixing with fresh air.

Conveyor means 22 may comprise a suitable well-known roller conveyor for advancing articles such as fruit through a drying apparatus. In this example, the conveyor means 22 may comprise a frame 35 which supports at each side endless chains to which are attached transverse rollers 36, thus providing an endless roller-type conveyor. Suitable drive means, not shown, are provided for the conveyor 22 to cause the upper lay of the conveyor to advance through the drying apparatus at a selected linear rate of movement.

An exemplary conveyor means 22 may include rollers of $2\frac{1}{4}''$ in diameter, spaced at 3" axial spacing, and providing transverse openings 37, $\frac{3}{4}''$ in width. An exemplary linear rate of movement may be 10–20 feet per minute. While conveyor means 22 is illustrated in horizontal position, it will be understood that conveyor means 22 may also be slightly inclined, if desired. Also, at spaced intervals along its length, a roller of noncylindrical cross section may be inserted in the endless roller conveyor so that change in position of the fruit relative to the rollers may be provided for more completely exposing all surfaces of the fruit to drying air.

Articles to be dried or such fruit as indicated at 40 may be fed to the conveyor means 22 in well-known manner. Such fruit is fed to provide a uniform layer of fruit extending across the width of conveyor means 22 and for the entire length of the conveyor means. Various well-known means, not shown, are provided for spreading such fruit evenly across the top of a conveyor. It may be desirable that the fruit be supplied to the conveyor means 22 to form one or two layers of fruit providing a stratum of fruit on top of the conveyor means 22.

It will be apparent that when such a stratum of articles to be dried or fruit 40 are provided on the conveyor means that the upper lay of the conveyor means and the strata of fruit form a perforate zone in which the open areas are in the order of 10 to 25 percent of the aggregate area of the upper lay of the conveyor means within the housing means 21.

Housing means 21 is preferably made of modular housing sections which include an inlet end housing section 42, an outlet end housing section 43 and one or more intermediate housing sections 44. In this example, only one intermediate housing section is shown. Generally speaking, each housing section provides a substantially closed chamber, such as 42*a*, 43*a* and 44*a*, respectively. The conveyor means 22 passing continuously through said chambers 42*a*, 44*a* and 43*a* divides each of said chambers into a plenum lower chamber space 42*b*, 43*b* and 44*b*, respectively. Above the conveyor means 22, upper chamber spaces 42*c*, 43*c* and 44*c* are provided.

Inlet end section 42 includes exterior side walls 46 and an interior longitudinally extending partition wall 47 which defines with exterior wall 46, chamber 42*a* through which the conveyor means 22 passes. Partition wall 47 also defines with the other exterior side wall 46, air passageway means 48 at one side of conveyor means 22. Partition wall 47 extends from top wall 49 to just below conveyor means 22 and defines with a floor surface 50, an opening 51 for flow of air through passageway means 48 to plenum chamber 42*b*. End housing section 42 also includes an end wall 53 having an opening 54 for entry of conveyor means 22 and a transverse wall 55 having a transverse opening for conveyor means 22 so that the plenum lower chamber space and the upper chamber space is substantially closed except for the conveyor means 22 and a desired strata of articles thereon.

In addition, housing section 42 includes a transversely upwardly inclined bottom wall 56 which extends from the bottom of opening 51 upwardly to the opposite wall 46 and at a selected angle so that drying air entering the plenum chamber 42*b* through opening 51 will be directed against the perforate zone formed by the conveyor means 22 and the strata of fruit thereon in substantially uniform manner.

Outlet end housing section is constructed similarly to the inlet end housing section with respect to defining the plenum lower chamber space 43*b*, the upper chamber space 43*c*, and air passageway means outboardly of the conveyor means 22. Outlet end housing section includes the controlled exhaust duct 33 and also provides the entry 32 into the passageway means for recycling of drying air.

Intermediate housing section 44 is similarly constructed with respect to the bottom plenum chamber space 44*b*, upper chamber space 42, 44*c* and the air passageway means 48 outboardly of the conveyor means 22. It will be understood that if the capacity of the drying apparatus requires modification, additional intermediate sections 44 may be readily installed between the inlet and outlet end housing sections. Each housing section thus comprises a modular unit having virtually the same wall construction to provide the necessary chambers and passageway means.

Means for circulating drying air through the housing means includes an air mixing and heating housing portion 60 located on top of inlet end housing section 42. Housing portion 60 includes a fresh air inlet duct 61 provided with suitable damper control means 62 for admitting a selected volume of air to housing portion 60. Housing portion 60 includes a mixing chamber 63 into which the fresh air duct 61 enters and also opening 27 of the recycling air passageway means 32. The fresh air and recycled air is passed through a suitable heat exchanger means 64 generally indicated in housing portion 60. The intermixed air, after being heated to a selected temperature by the heat exchange means 64, is drawn from the chamber formed by housing portion 60 by a first blower means 30 which discharges the heated drying air into the passageway means 48 at one side of the conveyor means 22. Blower means 30 discharges drying air at a selected volume and flow rate into passageway 48 where it flows downwardly through the outboard passageway means 48 and through the opening 51 to the plenum lower chamber space **42*b*. The heated drying air is then passed upwardly through the rolls of the conveyor means 22 and through the fruit carried thereby for uniform flow through the perforate zone formed by the conveyor means 22 and the strata of fruit. Inlet end housing section also includes blower 31 which draws air from upper chamber space 42*c* and discharges said air into the passageway means outboardly of the conveyor means of the intermediate housing section 44** for flow of the drying air into the plenum lower chamber space and the upwardly through the conveyor means and fruit strata thereon.

This flow concept is again repeated in the intermediate housing section 44 and outlet housing section 43 where the blower 31 of the intermediate housing section 44 draws drying air from the upper chamber space **44*c* and moves such drying air into the lower chamber space of outlet end housing 43. At outlet end housing section 43, the air may be partially discharged to atmosphere and partially recycled through passageway means 32**.

To provide uniform flow of drying air through the drying apparatus, each of the blower means 31 are adjusted to move air at substantially the same flow rate. Since the drying air is being moved at a substantially uniform flow rate through the drying apparatus and since the perforate zone defined by the conveyor means 22 and the fruit strata thereon is substantially uniform across the width of the conveyor throughout the length of the housing sections, it will be apparent that substantially uniform heat is applied to the fruit being passed through each housing section. Thus, uniform drying of fruit across the width and length of the conveyor is achieved.

Blower fans 30 and 31 are perferably of the type which includes backward inclined blades arranged as a wheel and sometimes referred to as a plug fan. Such a plug fan requires no housing and is particularly adapted to draw air from the upper chamber and then direct it sidewardly and downwardly into the air passageway means at the side of the conveyor. It will be understood that other types of fans may be used; although for this purpose, it is believed that the plug type fan is most efficient.

Instrumentation, not shown, is provided to measure temperature and humidity in the dryer apparatus, particularly at the outlet housing section for control of the exhaust duct 33 and to regulate the inflow of fresh air at the fresh air duct 61. A desired temperature range in the dryer housing sections may vary from 100° F. to 130° F. and a desired humidity range may vary from 20% to 30% relative humidity. Recycled heated air is utilized, and while it is partially reheated at the heat exchanger in a mixture of fresh air, a savings in BTU's required is effected.

An exemplary apparatus embodying this invention for drying of fruit which has been coated with an aqueous wax composition material in which the wax may contain approximately 18% solids and the remainder being water may have the following general characteristics.

(1) A conveyor means 24 feet long and 6 feet wide.
(2) A heat exchanger capable of 400,000 BTU output.
(3) Blower means having an aggregate horsepower requirement of 9½ hp.
(4) Air supply at approximately 9,000 to 10,000 CFM.
(5) Recirculation air at 6,000 to 8,500 CFM.
(6) Exhaust air up to approximately 3,000 CFM
(7) A fresh air supply 500 to 3,000 CFM
(8) Conveyor speed about 10–20 ft. per minute.

In operating conditions, the exemplary apparatus having characteristics above described may be operated with positive pressure in the drying chambers of about ½ inch water. Preferably, an equal volume of air is passed through each chamber by control of the blower means 30 and 31 and by maintaining a virtually uniform spread of fruit or articles to be dried upon the conveyor means so that the perforate zone there provided will facilitate action of the lower plenum chamber in uniform distribution of drying air introduced into the plenum chamber for passage upwardly through the perforate zone.

Since each housing section provides a substantially closed drying chamber and since the drying air is passed into the lower plenum chamber space and then upwardly through the conveyor and layer of fruit, it may be desirable at the boundaries of the chamber to interpose between the lays of the conveyor at each housing section wall a flexible partition which will restrict flow of drying air from the plenum chamber space through the space between conveyor lays and into the adjacent housing section chamber.

It will be apparent to those skilled in the art that the drying apparatus described above provides efficient drying while requiring less horsepower, less air to be heated, faster drying, selected humidity and temperature and uniformity of drying and flow of drying air upwardly through the area defined by the conveyor. The introduction of drying air into a plenum chamber below the conveyor and strata of fruit and the outflow of drying air from the upper chamber through a passageway which lies to one side of the conveyor provides an effective, efficient recirculation of drying air.

Various modifications and changes may be made in the method and apparatus of the invention described above which may come within the spirit of this invention and all such changes and modifications coming within the scope of the appended claims are embraced thereby.

I claim:

1. In a method of drying aqueous coatings on articles such as fruit and the like, the steps of:

providing a substantially closed chamber having a conveyor path of selected width along which one or more layers of articles are advanced with aggregate area of openings through said conveyor path and article layer being in the order of 10% to 25% of the total area of said path in said chamber;

transversely directing heated air into the bottom of said chamber at a selected flow rate below said path to pass the heated air through said openings to chamber space above said path;

removing air in a transverse direction from the chamber space above said path at a flow rate substantially the same as the flow rate of air directed into said chamber below said path, while maintaining a selected pressure in said chamber below said path;

whereby passage of heated air through said openings and about said articles over the total area of said path in said layer is substantially uniform;

intermixing part of the air removed from the chamber space above said path with fresh air to provide desired humidity and temperature of the air mixture;

and directing the intermixed air into said closed chamber below said path.

2. In a method of drying aqueous coatings applied to fruit including the steps of:

providing a plurality of intercommunicating substantially closed chamber sections having a continuous path through said sections along which a strata of fruit is advanced with openings in said path and fruit strata generally uniformly arranged along the length and width of said path;

intermixing fresh and recycled air and heating said air mixture to a selected temperature and at a selected humidity;

directing said intermixed air beneath said path of said first chamber section for upward passage through said openings and fruit strata for drying contact with said fruit on said path;

removing drying air from the chamber space above said path and directing such removed air to the chamber space below said path in the next adjacent downstream closed chamber section;

passing drying air in said adjacent chamber section upward through said openings in said path and fruit strata for further drying of fruit as it is moved along said path;

removing air from said adjacent closed chamber section above said path and directing it downstream to adjacent chamber sections for further drying of fruit in like manner;

and returning a selected portion of said air from said last downstream closed chamber section to said upstream end of said path for intermixing with fresh air for recycling thereof.

3. In a method as stated in claim 2 including the step of:

maintaining substantially uniform volume flow of drying air through each closed chamber section and between adjacent chamber sections by simultaneously directing drying air upwardly through said path and drawing air from above said path for transfer to the next adjacent chamber section.

4. In a method as stated in claim 2 including the step of:

providing one or more layers of fruit on said path to provide a strata of fruit on said path in which openings through said path and strata are in the order of 10 to 25 percent of the aggregate area of said path in each closed chamber section.

5. In a dryer apparatus for articles such as fruit and the like to which applications of aqueous coatings have been made, for removal of water from said coatings on said fruit, the combination of:

a dryer housing means providing inlet and outlet ends and a passageway means for returning air from adjacent said outlet end to said inlet end;

a heat exchanger means adjacent said inlet end;

fresh air inlet means adjacent said inlet end;

first blower means for blowing intermixed heated and recycled air of selected temperature and humidity in said inlet end;

a continuous conveyor for articles extending through said housing means;

said housing means including an inlet end housing section, an outlet end housing section, and one or more intermediate housing sections;

each of said housing sections providing a substantially closed chamber about the portion of the continuous conveyor passing therethrough and having a plenum lower chamber space beneath said conveyor and an upper chamber space above said conveyor;

said conveyor and said articles thereon providing a perforate zone for passage of intermixed heated air from said lower chamber spaces in each housing section to said upper chamber spaces;

blower means for moving the same volume of said intermixed heated air continuously through and to each of said housing sections including a blower at each housing section for removing air from the upper chamber space above said conveyor in each chamber section and for directing and introducing said removed air of the same volume into the lower plenum chamber space in the next adjacent downstream chamber section for passage through the perforate zone in said latter chamber section.

6. In a dryer apparatus as stated in claim 5 wherein:

each housing section includes air passageway means at one side of said conveyor for introducing said intermixed air to the lower plenum chamber of the downstream adjacent housing section.

7. In a dryer apparatus as stated in claim 5 wherein:

each blower in each housing section includes control means for substantially equalizing the flow rate of said air in and between each housing section.

8. In an apparatus as stated in claim 7 wherein:

said outlet end housing section includes a controllable exhaust means for discharging humidified drying air in selected amounts from the upper chamber space of said outlet end housing section to atmosphere.

* * * * *